US006929174B1

(12) United States Patent
Ly

(10) Patent No.: US 6,929,174 B1
(45) Date of Patent: Aug. 16, 2005

(54) MAILBOX

(76) Inventor: Tristan Ly, 1469 Hilltop St., Albernarle, NC (US) 28001

( * ) Notice: Subject to any disclaimer, the term of this patent is extended or adjusted under 35 U.S.C. 154(b) by 0 days.

(21) Appl. No.: 10/746,639

(22) Filed: Dec. 29, 2003

(51) Int. Cl.[7] ..... B65D 91/00
(52) U.S. Cl. ..... 232/38; 232/17
(58) Field of Search ..... 232/17, 38, 39, 232/45, 29

(56) References Cited

U.S. PATENT DOCUMENTS

| | | | | |
|---|---|---|---|---|
| 3,243,104 | A * | 3/1966 | Fillion | 232/33 |
| 3,275,229 | A | 9/1966 | Turner | |
| 4,244,512 | A | 1/1981 | Wise | |
| 4,650,113 | A | 3/1987 | Hunt | |
| 4,951,905 | A * | 8/1990 | Bronson et al. | 248/152 |
| 5,000,380 | A | 3/1991 | Barrios | |
| 5,123,590 | A | 6/1992 | Teele | |
| D332,166 | S | 12/1992 | Williams | |
| 5,465,902 | A * | 11/1995 | Hanson | 232/33 |
| 6,629,634 | B2 * | 10/2003 | Simmons | 232/45 |
| 6,811,076 | B1 * | 11/2004 | Engberg | 232/38 |
| 6,845,904 | B1 * | 1/2005 | South | 232/38 |
| 2003/0213837 | A1 * | 11/2003 | Morgan | 232/38 |

* cited by examiner

*Primary Examiner*—William L. Miller

(57) ABSTRACT

A mailbox includes a housing having a front portion and being formed from transparent material so that a user may view inside the housing from an exterior thereof. A front door is pivotally connected to the housing and preferably includes a transparent portion disposed substantially medially between a perimeter thereof. A cover plate is removably positionable in front of the transparent portion for preventing a person from seeing therethrough and into the housing. A locking mechanism releasably maintains the front door at a closed position. A plurality of members are pivotally connected to the housing and movable between up and down positions for covering the front transparent portion of the housing so that a person cannot see inside the housing when standing at an exterior thereof.

20 Claims, 2 Drawing Sheets

MAILBOX

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a mailbox and, more particularly, to a mailbox including a plurality of transparent sections for allowing a user to identify whether the mailbox contains mail therein.

2. Prior Art

Roadside mailboxes typically include a single door, which faces the roadway and is used both to deposit mail and to remove mail from the box. The mailbox is often located a considerable distance from the house, and it is necessary for the recipient to walk out to the mailbox and check to determine whether the mail has arrived. Although many mailboxes are equipped with signal flags, they are not used consistently and do not detract appreciably from the number of trips that must be made to and from the mailbox.

Mailboxes that are wholly or partially transparent have been proposed so that the contents of the box are visible from a considerable distance. However, if a single envelope or several envelopes or other flat pieces of mail are present in the mailbox, they are difficult to see from a distance because of their horizontal position on the floor of the mailbox. Another drawback associated with transparent mailboxes is that persons passing by on the road can see that mail is present and possibly tamper with it.

The retrieval of mail from conventional mailboxes is especially difficult for the elderly. It is necessary to walk around to the roadside of the mailbox and open the door, to stoop down to see if any mail is present, and to reach into the mailbox to remove the mail. The need to stand on the roadside of the mailbox can be dangerous, and the need to stoop down and reach into the box is especially difficult for elderly persons.

Mailboxes having doors on both ends have been proposed so that the mail can be deposited from the roadside of the mailbox and removed from the house side. However, the house side access opening is located at the end of the box, and it is still necessary for the recipient to stoop down to check for the presence of mail and to reach into the end of the mailbox to remove it. In addition, if the mail carrier is careless in depositing the mail in the box, it can slide through the box and fall completely or partially out through the back or house side door.

BRIEF SUMMARY OF THE INVENTION

In view of the foregoing background, it is therefore an object of the present invention to provide a mailbox including a plurality of transparent portions for allowing a user to determine whether mail has been delivered. These and other objects, features, and advantages of the invention are provided by a mailbox for maintaining mail therein and including a housing having a longitudinal axis and including a substantially planar bottom surface having opposed side edge portions equally spaced from the longitudinal axis and extending substantially parallel thereto along a length of the housing.

The housing further includes a non-planar top surface integral with the bottom surface and extending upwardly from the opposed side edge portions thereof. The housing may also include a front portion integral with the top surface and formed from transparent material so that a user may view inside the housing from an exterior thereof.

The present invention preferably includes a support plate including a substantially planar surface and opposed side edge portions integral therewith extending upwardly therefrom. The support plate is disposed beneath the housing and connected thereto for providing reinforcement to the bottom surface. A front door including opposed bottom edge portions is pivotally connected to the side edge portions of the support plate. The front door preferably includes a transparent portion disposed substantially medially between a perimeter thereof.

The present invention may further include a cover plate removably positionable in front of the transparent portion for preventing a person from seeing therethrough and into the housing. A locking mechanism releasably maintains the front door at a closed position. The present invention may also include a plurality of members pivotally connected to the housing and movable between up and down positions for covering the front transparent portion of the housing so that a person cannot see inside the housing when standing at an exterior thereof.

The side edge portions of the support plate are preferably engaged with the top surface of the housing. The front door may be formed from transparent material. The plurality of members include top end portions pivotally connected to preferably the top surface of the housing. The present invention may further include a flag member pivotally connected to the top surface and movable between down and up positions for identifying whether the housing contains outgoing mail.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime and double prime notations are used to indicate similar elements in alternate embodiments.

Figure 1:
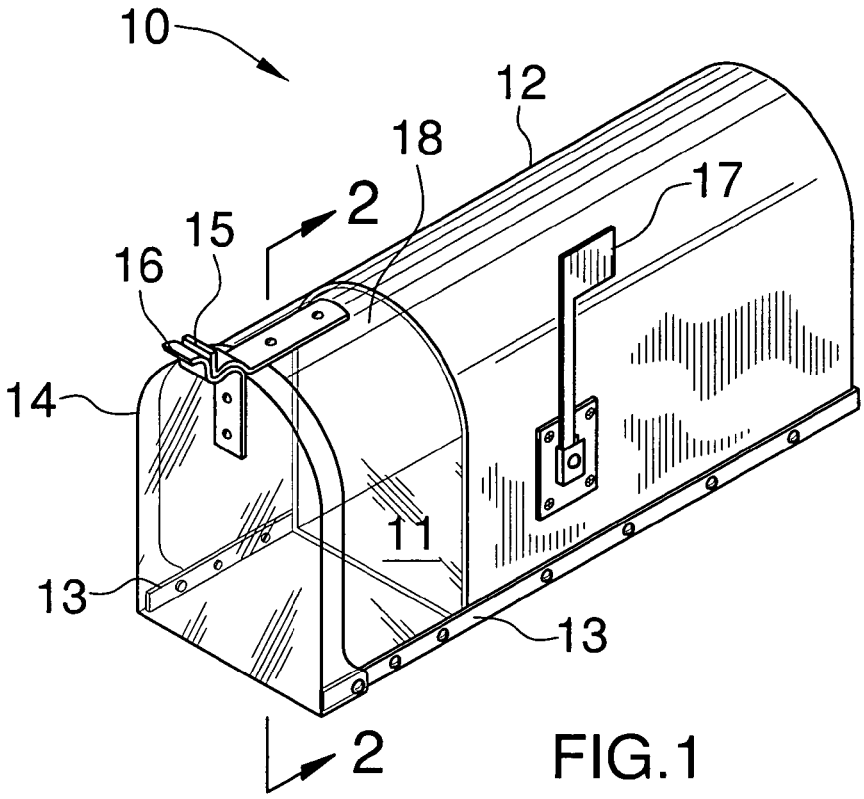
FIG. 1 is a perspective view showing a mailbox, in accordance with the present invention.
Figure 2:
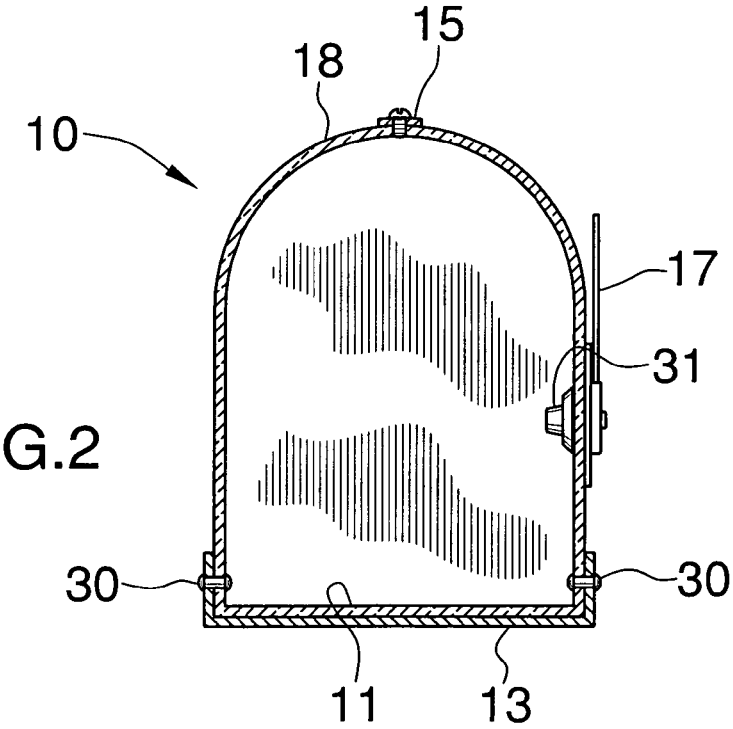
FIG. 2 is an enlarged cross-sectional view taken along line 2—2 in FIG. 1.

The apparatus of this invention is referred to generally in FIG. 1 by the reference numeral 10 and is intended to provide a mailbox including a plurality of transparent portions. It should be understood that the mailbox 10 may be used for both residential and commercial purposes.

The mailbox 10 includes a housing having a longitudinal axis and including a substantially planar bottom surface 11 having opposed side edge portions equally spaced from the longitudinal axis (not shown) and extending substantially parallel thereto along a length of the housing. The housing further includes a non-planar top surface 12 integral with the bottom surface 11 and extending upwardly from the opposed side edge portions thereof.

Both the top and bottom surfaces 12, 11, respectively, may be formed from conventional nontransparent and/or transparent material. For example, the housing preferably includes a front portion 18 integral with the top surface 12 and formed from transparent material so that a user may view inside the housing from an exterior thereof.

A support plate 13 includes a substantially planar surface extending across the bottom surface 11 and includes opposed side edge portions integral therewith. Such side edge portions extend substantially perpendicularly upwardly from the planar surface of the support plate 13. The support plate is disposed beneath the housing and connected thereto for providing reinforcement to the bottom surface 11. In particular, the side edge portions of the support plate 13 are preferably engaged with the top surface 12 of the housing.

A front door 14 including opposed bottom edge portions is pivotally connected to the side edge portions of the support plate 13 via conventional fasteners 30. The front door 14 is formed from transparent material, in a manner similar to the front portion 18 of the housing. A pair of brackets 15, 16 are releasably engageable with each other for assisting to maintain the front door 14 at a closed position. A conventional flag member 17 is pivotally connected to the top surface 12 and is movable between down and up positions for identifying whether the mailbox 10 contains outgoing mail. In particular, a control knob 31 helps control the movement of the flag member 17.

Figure 3:
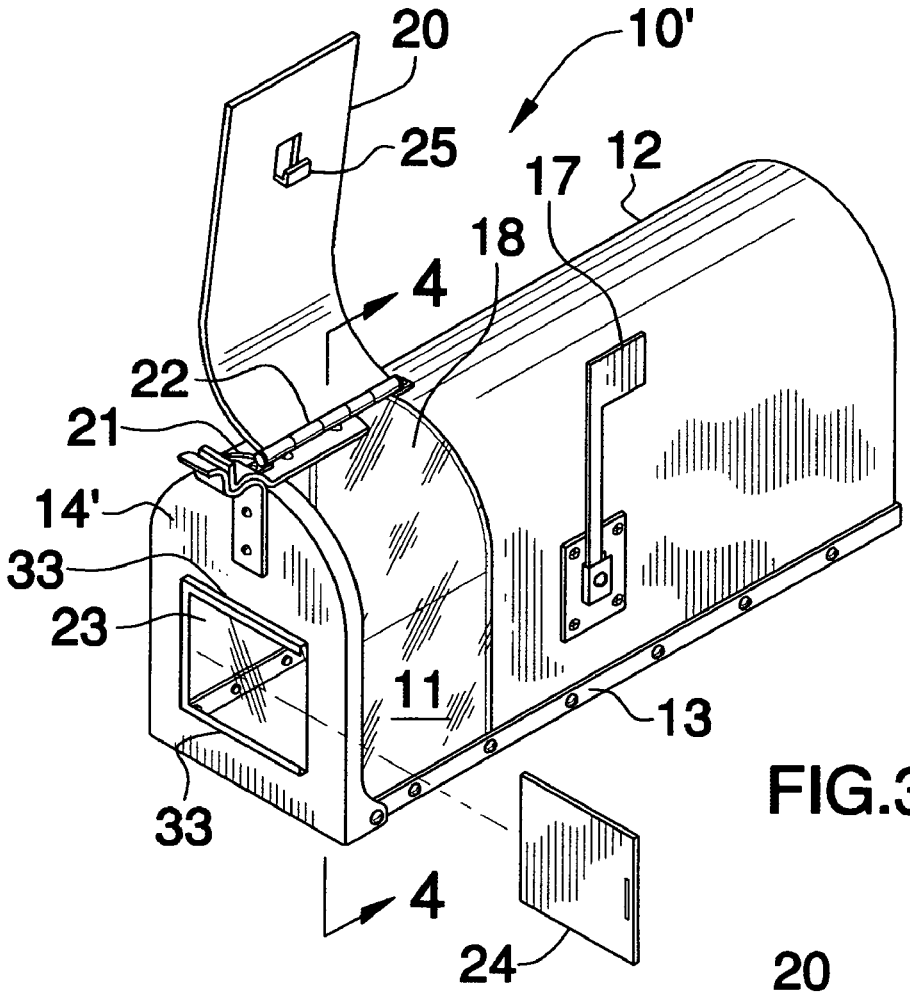
FIG. 3 is a perspective view showing an alternate embodiment of the mailbox shown in FIG. 1.
Figure 4:
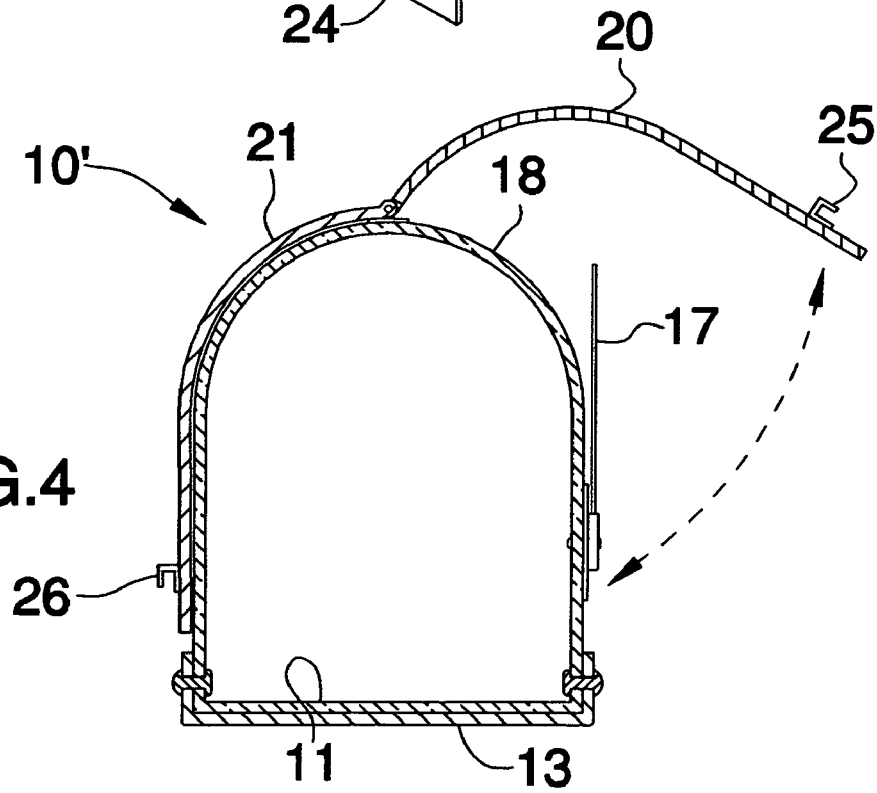
FIG. 4 is an enlarged cross-sectional view taken along line 4—4 in FIG. 3.

Now referring to FIGS. 3 and 4, an alternate embodiment 10' is illustrated wherein the front door 14' preferably includes a transparent portion 23 disposed substantially medially between a perimeter thereof. A cover plate 24 is removably positionable in front of the transparent portion 24 for preventing a person from seeing therethrough and into the housing. In particular, such a transparent portion includes a plurality of grooves 33 along a perimeter thereof for receiving the side edge portions of cover plate 24. Of course, the transparent portion 23 and the associated cover plate 24 may be formed in various shapes such as oval and triangular, for example.

Notably, a plurality of members 20, 21 are pivotally connected to the housing and movable between up and down positions for covering the front transparent portion 18 of the housing so that a person cannot see inside the housing when standing at an exterior thereof. The pair of members 20, 21 include top end portions pivotally connected to preferably the top surface 12 of the housing via a conventional elongate hinge 22 disposed generally medially of the housing apex and aligned with bracket 15. Each member 20, 21 includes a handle portion 25, 26, respectively extending outwardly therefrom for assisting a user to open and close such members 20, 21.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A mailbox for maintaining mail therein and comprising:

a housing having a longitudinal axis and including a substantially planar bottom surface having opposed side edge portions equally spaced from the longitudinal axis and extending substantially parallel thereto along a length of said housing, said housing further including a non-planar top surface integral with said bottom surface and extending upwardly from said opposed side edge portions thereof, said housing including a front portion integral with said top surface and formed from transparent material so that a user may view inside said housing from an exterior thereof;

a support plate including a substantially planar surface and opposed side edge portions integral therewith and extending upwardly therefrom, said support plate being disposed beneath said housing and being connected thereto for providing reinforcement to said bottom surface;

a front door including opposed bottom edge portions pivotally connected to said side edge portions of said support plate; and locking means for releasably maintaining said front door at a closed position.

2. The mailbox of claim 1, wherein said side edge portions of said support plate are engaged with said top surface of said housing.

3. The mailbox of claim 1, wherein said front door is formed from transparent material.

4. The mailbox of claim 1, further comprising a plurality of members pivotally connected to said housing and being movable between up and down positions for covering said front transparent portion of said housing so that a person cannot see inside said housing when standing at an exterior thereof.

5. The mailbox of claim 4, wherein said plurality of members include top end portions pivotally connected to said top surface of said housing.

6. The mailbox of claim 1, wherein said front door member comprises a transparent portion disposed substantially medially between a perimeter thereof.

7. The mailbox of claim 1, wherein said front door member comprises:

a transparent portion disposed substantially medially between a perimeter thereof; and a cover plate removably positionable in front of said transparent portion for preventing a person from seeing therethrough and into said housing.

8. The mailbox of claim 1, further comprising a flag member pivotally connected to said top surface and being movable between down and up positions for identifying whether said housing contains outgoing mail.

9. A mailbox for maintaining mail therein and comprising:

a housing having a longitudinal axis and including a substantially planar bottom surface having opposed side edge portions equally spaced from the longitudinal axis and extending substantially parallel thereto along a length of said housing, said housing further including a non-planar top surface integral with said bottom surface and extending upwardly from said opposed side edge portions thereof, said housing including a front portion integral with said top surface and formed from transparent material so that a user may view inside said housing from an exterior thereof;

a support plate including a substantially planar surface and opposed side edge portions integral therewith and extending upwardly therefrom, said support plate being disposed beneath said housing and being connected thereto for providing reinforcement to said bottom surface;

a front door including opposed bottom edge portions pivotally connected to said side edge portions of said support plate;

locking means for releasably maintaining said front door at a closed position; and a plurality of members pivotally connected to said housing and being movable between up and down positions for covering said front transparent portion of said housing so that a person cannot see inside said housing when standing at an exterior thereof.

10. The mailbox of claim 9, wherein said side edge portions of said support plate are engaged with said top surface of said housing.

11. The mailbox of claim 9, wherein said front door is formed from transparent material.

12. The mailbox of claim 9, wherein said plurality of members include top end portions pivotally connected to said top surface of said housing.

13. The mailbox of claim 9, wherein said front door member comprises a transparent portion disposed substantially medially between a perimeter thereof.

14. The mailbox of claim 9, wherein said front door member comprises:

a transparent portion disposed substantially medially between a perimeter thereof; and a cover plate removably positionable in front of said transparent portion for preventing a person from seeing therethrough and into said housing.

15. The mailbox of claim 9, further comprising a flag member pivotally connected to said top surface and being movable between down and up positions for identifying whether said housing contains outgoing mail.

16. A mailbox for maintaining mail therein and comprising:

a housing having a longitudinal axis and including a substantially planar bottom surface having opposed side edge portions equally spaced from the longitudinal axis and extending substantially parallel thereto along a length of said housing, said housing further including a non-planar top surface integral with said bottom surface and extending upwardly from said opposed side edge portions thereof, said housing including a front portion integral with said top surface and formed from transparent material so that a user may view inside said housing from an exterior thereof;

a support plate including a substantially planar surface and opposed side edge portions integral therewith and extending upwardly therefrom, said support plate being disposed beneath said housing and being connected thereto for providing reinforcement to said bottom surface;

a front door including opposed bottom edge portions pivotally connected to said side edge portions of said support plate, said front door further including a transparent portion disposed substantially medially between a perimeter thereof, and a cover plate removably positionable in front of said transparent portion for preventing a person from seeing therethrough and into said housing;

locking means for releasably maintaining said front door at a closed position; and a plurality of members pivotally connected to said housing and being movable between up and down positions for covering said front transparent portion of said housing so that a person cannot see inside said housing when standing at an exterior thereof.

17. The mailbox of claim 16, wherein said side edge portions of said support plate are engaged with said top surface of said housing.

18. The mailbox of claim 16, wherein said front door is formed from transparent material.

19. The mailbox of claim 16, wherein said plurality of members include top end portions pivotally connected to said top surface of said housing.

20. The mailbox of claim 16, further comprising a flag member pivotally connected to said top surface and being movable between down and up positions for identifying whether said housing contains outgoing mail.

* * * * *